US006056171A

United States Patent [19]

Santamaria

[11] Patent Number: 6,056,171

[45] Date of Patent: May 2, 2000

[54] SOCK DONNING AID

[76] Inventor: Eugene Santamaria, Star Rte. 1 Box 164, Crescent City, Fla. 32112

[21] Appl. No.: 09/301,735

[22] Filed: Apr. 29, 1999

[51] Int. Cl.[7] ..... A47G 25/90

[52] U.S. Cl. ..... 223/112; 223/111

[58] Field of Search ..... 223/111, 112, 223/113, 118, 119, 1

[56] References Cited

U.S. PATENT DOCUMENTS

| | | | |
|---|---|---|---|
| 732,864 | 7/1903 | Hepner | 223/112 |
| 841,192 | 1/1907 | Sommer | 223/118 |
| 990,283 | 4/1911 | Merrow | 223/118 |
| 1,781,748 | 11/1930 | Chapper et al. | 223/111 |
| 5,909,831 | 6/1999 | Griffin | 223/112 |

*Primary Examiner*—Bibhu Mohanty

[57] ABSTRACT

A sock donning aid for holding open the ankle opening of a sock for aiding the insertion of a user's foot into the sock. The sock donning aid includes an elongate main member a proximal handle portion, a distal heel portion, and a bend interposed between the proximal handle portion and the distal heel portion. The main member has a finger hook at a proximal end of the main member. The main member has a spaced apart pair of elongate side wing coupled thereto and forwardly extending from the distal end of the main member.

8 Claims, 2 Drawing Sheets

SOCK DONNING AID

BACKGROUND OF THE INVENTION

1. Field of the Invention

The present invention relates to sock donning aids and more particularly pertains to a new sock donning aid for holding open the ankle opening of a sock for aiding the insertion of a user's foot into the sock.

2. Description of the Prior Art

The use of sock donning aids is known in the prior art. More specifically, sock donning aids heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,066,194; U.S. Pat. No. 5,082,154; U.S. Pat. No. Des. 365,913; U.S. Pat. No. 5,626,269; U.S. Pat. No. 3,452,907; and U.S. Pat. No. 3,310,209.

While these devices fulfill their respective, particular objectives and requirements, the aforementioned patents do not disclose a new sock donning aid. The inventive device includes an elongate main member a proximal handle portion, a distal heel portion, and a bend interposed between the proximal handle portion and the distal heel portion. The main member has a finger hook at a proximal end of the main member. The main member has a spaced apart pair of elongate side wing coupled thereto and forwardly extending from the distal end of the main member.

In these respects, the sock donning aid according to the present invention substantially departs from the conventional concepts and designs of the prior art, and in so doing provides an apparatus primarily developed for the purpose of holding open the ankle opening of a sock for aiding the insertion of a user's foot into the sock.

SUMMARY OF THE INVENTION

In view of the foregoing disadvantages inherent in the known types of sock donning aids now present in the prior art, the present invention provides a new sock donning aid construction wherein the same can be utilized for holding open the ankle opening of a sock for aiding the insertion of a user's foot into the sock.

The general purpose of the present invention, which will be described subsequently in greater detail, is to provide a new sock donning aid apparatus and method which has many of the advantages of the sock donning aids mentioned heretofore and many novel features that result in a new sock donning aid which is not anticipated, rendered obvious, suggested, or even implied by any of the prior art sock donning aids, either alone or in any combination thereof.

To attain this, the present invention generally comprises an elongate main member a proximal handle portion, a distal heel portion, and a bend interposed between the proximal handle portion and the distal heel portion. The main member has a finger hook at a proximal end of the main member. The main member has a spaced apart pair of elongate side wing coupled thereto and forwardly extending from the distal end of the main member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new sock donning aid apparatus and method which has many of the advantages of the sock donning aids mentioned heretofore and many novel features that result in a new sock donning aid which is not anticipated, rendered obvious, suggested, or even implied by any of the prior art sock donning aids, either alone or in any combination thereof.

It is another object of the present invention to provide a new sock donning aid which may be easily and efficiently manufactured and marketed.

It is a further object of the present invention to provide a new sock donning aid which is of a durable and reliable construction.

An even further object of the present invention is to provide a new sock donning aid which is susceptible of a low cost of manufacture with regard to both materials and labor, and which accordingly is then susceptible of low prices of sale to the consuming public, thereby making such sock donning aid economically available to the buying public.

Still yet another object of the present invention is to provide a new sock donning aid which provides in the apparatuses and methods of the prior art some of the advantages thereof, while simultaneously overcoming some of the disadvantages normally associated therewith.

Still another object of the present invention is to provide a new sock donning aid for holding open the ankle opening of a sock for aiding the insertion of a user's foot into the sock.

Yet another object of the present invention is to provide a new sock donning aid which includes an elongate main member a proximal handle portion, a distal heel portion, and a bend interposed between the proximal handle portion and the distal heel portion. The main member has a finger hook at a proximal end of the main member. The main member has a spaced apart pair of elongate side wing coupled thereto and forwardly extending from the distal end of the main member.

Still yet another object of the present invention is to provide a new sock donning aid that provides an aid for user's having limited mobility or flexibility to don their socks on their own and without the aid of others.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

With reference now to the drawings, and in particular to FIGS. 1 through 4 thereof, a new sock donning aid embodying the principles and concepts of the present invention will be described.

As best illustrated in FIGS. 1 through 4, the sock donning aid generally comprises an elongate main member a proximal handle portion, a distal heel portion, and a bend interposed between the proximal handle portion and the distal heel portion. The main member has a finger hook at a proximal end of the main member. The main member has a spaced apart pair of elongate side wing coupled thereto and forwardly extending from the distal end of the main member.

Figure 2:
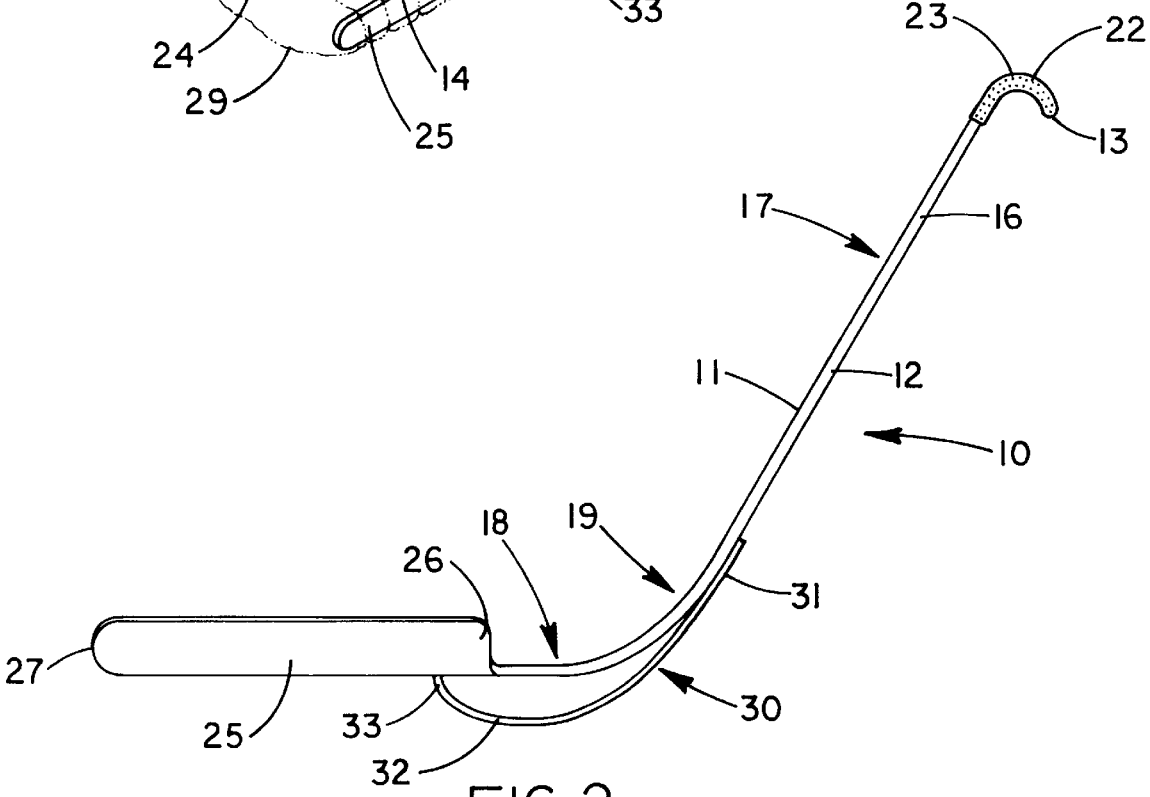
FIG. 2 is a schematic side view of the present invention.

In closer detail, the sock donning aid comprises an elongate main member 10 having substantially planar upper and lower faces 11,12, opposite proximal and distal ends 13,14, and a pair of side edges 15,16 extending between the proximal and distal ends of the main member. The main member is formed to have a proximal handle portion 17 and a distal heel portion 18. The proximal handle portion is positioned adjacent the proximal end of the main member and the distal heel portion is positioned adjacent the distal end of the main member. The main member also has an arcuate bend 19 interposed between the proximal handle portion and the distal heel portion. As best illustrated in FIG. 2, the arcuate bend of the main member has a concavity located on the upper face of sad main member and a convexity located on the lower face of the main member.

The distal heel portion is extended at an obtuse angle with respect to the proximal handle portion to permit positioning of a user's heel in front of the proximal handle portion during use. Preferably, the obtuse angle between the distal heel portion and the proximal handle portion is between about 30 degrees and about 80 degrees. Ideally, the obtuse angle between the distal heel portion and the proximal handle portion is about 60 degrees.

The side edges of the main member each have a proximal portion along the proximal handle portion and a distal portion along the distal heel portion. The proximal portions of the side edges each have a convex upper arcuate region 20 and a concave lower arcuate region 21. The upper arcuate regions is positioned towards the proximal end of the main member and the lower arcuate regions is positioned towards the bend of the main member. During use, the lower arcuate portions are designed for helping slip a user's heel in front of the proximal handle portion.

The main member has a finger hook 22 formed at the proximal end of the main member. As best illustrated in FIG. 2, the finger hook has a downwardly facing concavity on the lower face of the main member. In use, the finger hook is designed for grasping with the hand of a user such that the user's index finger is positioned in the concavity of the finger hook. In addition, this hook can be used when needed to assist the user to raise the sock to a desired height by inverting the main member and inserting the finger hook into the top of the sock and pulling upwards. Ideally, the finger hook has a resiliently deformable coating 23 thereon for providing additional comfort to the hand of the user grasping the finger hook.

Figure 3:
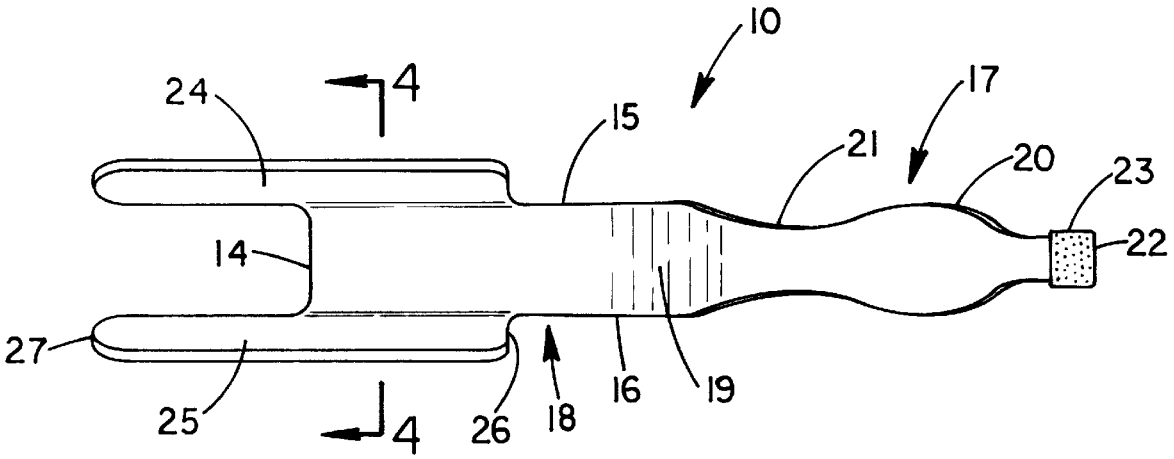
FIG. 3 is a schematic top view of the present invention.

As best depicted in FIG. 3, the distal heel portion has a generally rectangular outer perimeter comprising the distal end of the main member and the distal portions of the side edges of the main member. The distal portions of the side edges are extended substantially parallel to one another and substantially perpendicular to the distal end of the main member. The distal portions of the side edges of the main member each have an generally rectangular elongate side wing 24,25 coupled thereto and upwardly extending from the upper face of the main member.

Figure 1:
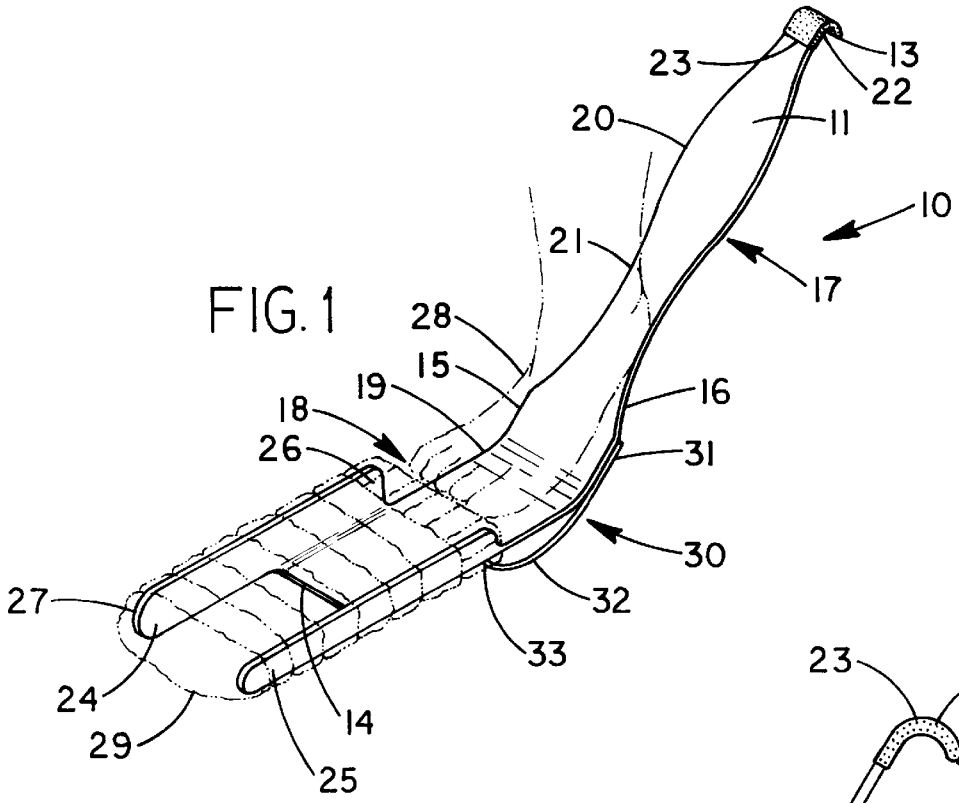
FIG. 1 is a schematic perspective view of a new sock donning aid in use according to the present invention.
Figure 4:
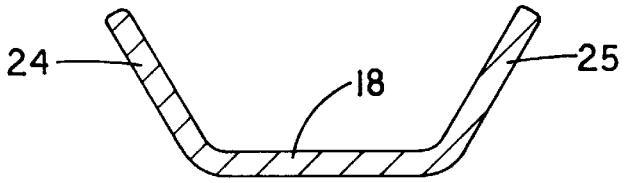
FIG. 4 is a schematic transverse cross sectional view taken from line 4—4 of FIG. 3.

The side wings each have opposite proximal and distal ends 26,27. The proximal ends of the side wings face in a direction towards the bend of the main member while the distal ends of the side wings are forwardly extended from the distal end of the main member. As best illustrated in FIGS. 1 and 4, the side wings are spaced apart from one another and extending substantially parallel to one another to define a channel for sling the toes of a user's foot 28 therebetween. As illustrated in FIG. 4, the side wings each are extended at an obtuse angle with respect to the distal heel portion. Each of the side wings lies in a unique plane extending at an obtuse angle from a plane in which the distal heel portion lies. Preferably, the obtuse angles between the distal heel portion and each side wing are about equal to one another. Even more preferably, the obtuse angles between the distal heel portion and each side wing are each between about 30 degrees and about 80 degrees. Ideally, the obtuse angles between the distal heel portion and each side wing are each about 60 degrees.

In use, as illustrated in FIG. 1, the distal ends of the side wings are designed for insertion into a sock 29 via an ankle opening of the sock so that the sock may be slid up on the side wings and bunched up on the side wings with the side wings holding the ankle opening open facing towards the bend of the main member. Preferably, the distal ends of the side wings are rounded to have a generally semi-circular perimeter for aiding insertion of the distal ends of the side wings into a sock without the distal ends getting caught on the woven material of the sock and thereby protect the sock from pulls and runs caused by the distal ends catching on the sock material.

Preferably, a heel support 30 is provided having an top portion 31 and an arcuate bottom portion 32 has an upwardly facing concavity. The top portion of the heel support is coupled to the lower face of the main member at a location on the proximal handle portion adjacent the bend of the main member. The arcuate bottom portion of the heel support has an end 33 opposite the top portion of the heel support coupled to the lower face of the main member at a location on the distal heel portion between the distal end of the main member and the bend of the main member. Even more preferably the end of the bottom portion of the heel support is located between the distal end of the main member and the proximal ends of the side wings, the concavity of the heel support facing towards the lower face of the main member. In use, the heel support is designed for providing additional structural strength to the bend of the main member and to space the distal heel portion above a ground surface when the heel support is rested on the ground surface.

In an ideal illustrative embodiment, the main member has an overall length between the ends of the main member of about 22¼ inches with the distal portions of the side edges spaced apart about 3½ inches. Also in this ideal embodiment, the side wings each have a length defined between the ends of the respective side wing of about 7¾ inches, and a width of about 1¾ inches. Preferably, the side wings extend beyond the distal end of the main member about 3¼ inches in this ideal illustrative embodiment.

In use, the side wings are inserted through the ankle opening of a sock so that the sock may be slid up and bunched up on the side wings with the ankle opening held open. A user then grasps the finger hook and positions the aid adjacent the foot of the user on which the sock is to be donned. The foot of the user is then slid into the held open ankle opening toe first and with the heel of the user slipping past one of the lower arcuate regions to be positioned in front of the proximal handle portion. As the user's foot is inserted into the sock, the sock is slowly pulled off of the wings while remaining on the user's foot. The use can also simultaneously pull the side wings out of the sock as the user's foot as the foot is inserted into the sock.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, failing within the scope of the invention.

I claim:

1. A sock donning aid, comprising:

an elongate main member having opposite proximal and distal ends, a pair of side edges extending between said proximal and distal ends, a proximal handle portion, a distal heel portion, and a bend interposed between said proximal handle portion and said distal heel portion;

said main member having a finger hook at said proximal end of said main member;

said side edges of said main member each having an elongate side wing coupled thereto and forwardly extending from said distal end of said main member; and a heel support having an top portion and an arcuate bottom portion having an upwardly facing concavity, said top portion of said heel support being coupled to a lower face of said main member at a location on said proximal handle portion adjacent said bend of said main member, said arcuate bottom portion of said heel support having an end opposite said top portion of said heel support coupled to said lower face of said main member at a location on said distal heel portion.

2. The sock donning aid of claim 1, wherein said distal heel portion is extended at an obtuse angle with respect to said proximal handle portion.

3. The sock donning aid of claim 2, wherein said obtuse angle between said distal heel portion and said proximal handle portion is between about 30 degrees and about 80 degrees.

4. The sock donning aid of claim 3, wherein said obtuse angle between said distal heel portion and said proximal handle portion is about 60 degrees.

5. The sock donning aid of claim 1, wherein said side edges of said main member each have a convex upper arcuate region and a concave lower arcuate region adjacent said proximal handle portion, said upper arcuate regions being positioned towards said proximal end of said main member, said lower arcuate regions being positioned towards said bend of said main member.

6. The sock donning aid of claim 1, wherein said side wings each are extended at an obtuse angle with respect to said distal heel portion.

7. The sock donning aid of claim 6, wherein said obtuse angles between said distal heel portion and each side wing are about equal to one another and wherein said obtuse angles between said distal heel portion and each side wing are each between about 30 degrees and about 80 degrees.

8. A sock donning aid, comprising:

an elongate main member having substantially planar upper and lower faces, opposite proximal and distal ends, and a pair of side edges extending between said proximal and distal ends of said main member;

said main member having a proximal handle portion and a distal heel portion, said proximal handle portion being positioned adjacent said proximal end of said main member, said distal heel portion being positioned adjacent said distal end of said main member;

said main member having an arcuate bend interposed between said proximal handle portion and said distal heel portion, said arcuate bend of said main member having a concavity located on said upper face of said main member and a convexity located on said lower face of said main member;

said distal heel portion being extended at an obtuse angle with respect to said proximal handle portion;

said side edges of said main member each having a proximal portion along said proximal handle portion and a distal portion along said distal heel portion;

said proximal portions of said side edges each having a convex upper arcuate region and a concave lower arcuate region, said upper arcuate regions being positioned towards said proximal end of said main member, said lower arcuate regions being positioned towards said bend of said main member;

said main member having a finger hook at said proximal end of said main member, said finger hook having a downwardly facing concavity on said lower face of said main member;

wherein said finger hook has a resiliently deformable coating thereon;

said distal heel portion having a generally rectangular outer perimeter comprising said distal end of said main member and said distal portions of said side edges of said main member, said distal portions of said side edges being extended substantially parallel to one another and substantially perpendicular to said distal end of said main member;

said distal portions of said side edges of said main member each having an generally elongate side wing coupled thereto;

said side wings each having opposite proximal and distal ends, said proximal ends of said side wings facing in a direction towards said bend of said main member, said it distal ends of said side wings being forwardly extended from said distal end of said main member;

said side wings being spaced apart from one another and extending substantially parallel to one another;

said side wings each being extended at an obtuse angle with respect to said distal heel portion;

wherein said obtuse angles between said distal heel portion and each side wing are about equal to one another;

wherein said distal ends of said side wings are rounded to have a generally semi-circular perimeter;

a heel support having an top portion and an arcuate bottom portion having an upwardly facing concavity;

said top portion of said heel support being coupled to said lower face of said main member at a location on said proximal handle portion adjacent said bend of said main member; and said arcuate bottom portion of said heel support having an end opposite said top portion of said heel support coupled to said lower face of said main member at a location on said distal heel portion between said distal end of said main member and said bend of said main member and located between said distal end of said main member and said proximal ends of said side wings, said concavity of said heel support facing towards said lower face of said main member.

* * * * *